US006158722A

United States Patent [19]

Gigas

[11] Patent Number: 6,158,722

[45] Date of Patent: Dec. 12, 2000

[54] MIXING SYSTEM FOR INTRODUCING AND DISPERSING GAS INTO LIQUIDS

[75] Inventor: Bernd Gigas, Churchville, N.Y.

[73] Assignee: General Signal Corporation, Rochester, N.Y.

[21] Appl. No.: 09/159,531

[22] Filed: Sep. 23, 1998

[51] Int. Cl.[7] ..... B01F 3/04

[52] U.S. Cl. ..... 261/84; 261/87; 261/93

[58] Field of Search ..... 261/29, 30, 36.1, 261/84, 87, 91, 93; 96/332, 334, 335

[56] References Cited

U.S. PATENT DOCUMENTS

| | | | |
|---|---|---|---|
| Re. 32,562 | 12/1987 | Litz . | |
| 1,383,881 | 7/1921 | Thomas | 261/87 |
| 1,579,355 | 4/1926 | Greenawalt | 261/87 |
| 1,632,758 | 6/1927 | Fulweiler et al. | 261/87 |
| 1,639,828 | 8/1927 | Wheeler et al. | 261/87 |
| 1,653,189 | 12/1927 | Oliphant | 261/87 |
| 2,639,129 | 5/1953 | De Rosset | 261/93 |
| 3,210,053 | 10/1965 | Boester | 261/93 |
| 3,274,075 | 9/1966 | Kersting | 261/87 |
| 3,677,528 | 7/1972 | Martin | 261/87 |
| 3,865,721 | 2/1975 | Kaelin | 261/93 |
| 3,953,326 | 4/1976 | Reimann . | |
| 3,969,446 | 7/1976 | Franklin, Jr. | 261/93 |
| 4,259,267 | 3/1981 | Wang . | |
| 4,290,885 | 9/1981 | Kwak . | |
| 4,371,480 | 2/1983 | Vos | 261/87 |
| 4,465,645 | 8/1984 | Kaelin | 261/93 |
| 4,882,098 | 11/1989 | Weetman . | |
| 4,896,971 | 1/1990 | Weetman et al. . | |
| 4,900,480 | 2/1990 | Litz et al. . | |
| 4,919,849 | 4/1990 | Litz et al. . | |
| 5,009,816 | 4/1991 | Weise et al. . | |
| 5,198,156 | 3/1993 | Middleton et al. . | |
| 5,431,860 | 7/1995 | Kozma et al. . | |
| 5,451,348 | 9/1995 | Kingsley . | |
| 5,451,349 | 9/1995 | Kingsley . | |

*Primary Examiner*—C. Scott Bushey
*Attorney, Agent, or Firm*—M. Lukacher; K. Lukacher

[57] ABSTRACT

A mixing system utilizes up pumping impellers which entrain gas into the liquid both at the surface (the gas liquid interface) and below the surface by induction to draw gas down below the surface where it is dispersed into the circulation produced by the impellers. The impellers are the axial flow type. Tubes disposed on the suction sides of the impeller blades, and providing gas outlets near the tips of the blades, rotate with the impellers. The tubes may extend along the shaft above the surface or into a hollow shaft having a breathing opening above the surface. The rotation of the impeller produces a suction at the tube outlets to draw gas into the liquid while the upward circulation produces surface turbulence for gas entrainment. The entrained gas from the surface and the gas discharged from the tubes is circulated. The system is less sensitive to variations in the level of the liquid between the impeller and the surface than is the case with the systems operating by surface gas entrainment or induction alone and even systems using induction and vortices created by down pumping impellers, as have heretofore been proposed. The gas transfer, as measured by the mass transfer co-efficient (kLa), is less sensitive to liquid level and the decrease of the mass transfer co-efficient with increasing liquid level is reduced.

16 Claims, 4 Drawing Sheets

MIXING SYSTEM FOR INTRODUCING AND DISPERSING GAS INTO LIQUIDS

The present invention relates to mixing systems for introducing or sparging gas into liquids in a tank. By liquids is meant to include liquid suspensions and slurries. Where the gas is air, such systems are sometimes called aeration systems. The system provided by the invention is effective for mass conversion of the gaseous phase into a liquid phase in order to carry out or promote reactions in various chemical and biological processes.

Dispersion or sparging of gas into a liquid medium in a tank using axial flow impellers, where the gas is released below the surface under pressure via a sparged pipe or ring, is described in Weetman, U.S. Pat. No. 4,882,098 issued Nov. 21, 1989 and Weetman and Howk, U.S. Pat. No. 4,896,971 issued Jan. 30, 1990. A gas liquid mixing system has also been proposed which uses a down pumping impeller within a draft tube shrouding the impeller to create a vortex for surface gas entrainment in the vortex while gas is introduced by suction created by the impeller. See Litz, et al, U.S. Pat. No. 4,919,849, Apr. 24, 1990. Reliance on the vortex for surface gas entrainment may increase the amount of gas introduced into the liquid over a varying range of liquid levels, but the system remains sensitive to liquid level changes and lacks the desired constancy of mass transfer over a range of liquid levels. These may include levels from where the surface of the liquid (the gas liquid interphase) intersects the impeller, leaving the impeller at the surface, to where the impeller is completely submerged. The efficiency of mass transfer, which may be measured by the mass transfer coefficient kLa should, desirably, remain essentially constant over the full range of liquid levels which may be encountered in the operation of the system.

It is a feature of the present invention to provide a mixing system for aeration or sparging of gas into liquids where dependence of gas introduction and efficiency of gas transfer is maintained essentially constant. In other words where the variation in mass transfer coefficient kLa with liquid level is reduced.

As a matter of general background to the art of gas to liquid transfer and mixing, reference may be had to the following U.S. patents: Kingsley U.S. Pat. Nos. 5,451,349, and 5,451,348, Sep. 19, 1995; Kozma, et al, U.S. Pat. No. 5,431,860, Jul. 11, 1995; Middleton, et al, U.S. Pat. No. 5,198,156, Mar. 30, 1993; Weise, et al, U.S. Pat. No. 5,009,816, Apr. 23, 1991; Litz, et al, U.S. Pat. No. 4,900,480, Feb. 13, 1990; Litz, U.S. Pat. No. RE. 32562, Dec. 15, 1987; Kwak, U.S. Pat. No. 4,290,885, Sep. 22, 1981; Wang, U.S. Pat. No. 4,259,267, Mar. 31, 1981; and Reimann, U.S. Pat. No. 3,953,326, Apr. 27, 1976.

It has been discovered in accordance with the invention that a substantially axial and upwardly directed flow pattern from an axial flow impeller enables gas to be introduced by surface entrainment without the creation of a vortex and also enables gas to be induced by suction created by the impeller below the surface in the vicinity of the impeller so as to be dispersed in the circulation created by the impeller. The induction of gas is preferably carried out by extending conduits in the form of tubes having outlets in the vicinity of the tips of the impellers, preferably close to the trailing edge of the impeller as it rotates. These conduits rotate with the impeller and communicates with gas above the liquid surface level by extending above the surface, either directly or via a hollow opening in the shaft which rotates the impeller. The mixing system so configured has been found to be less sensitive to variations in surface level and more constant in terms of the mass transfer efficiency, for example, as expressed by the mass transfer coefficient, kLa, than systems relying on surface entrainment alone, gas induction alone or gas induction with surface entrainment in a vortex formed by a down-pumping impeller.

Accordingly, it is the principal object of the invention to provide an improved mixing system for sparging and dispersion of gas into liquids.

It is another object of the invention to provide an improved mixing system for gas liquid transfer having a mass transfer coefficient, kLa, wherein the sensitivity to liquid variations is controlled without lowering the efficiency of the mixing system.

It is another object of the present invention to provide an improved mixing system for sparging and dispersing of gas into liquids utilizing induction of gas due to suction created by a rotating impeller, where the impeller may be located in close proximity to the surface thereby requiring less power to obtain tip speeds for creating suction to induce gas into the liquid, while promoting the entrainment of gas into liquid at the surface by causing the surface to well up and become turbulent.

Briefly described, a mixing system for circulating a liquid in a tank while introducing gas into the liquid utilizes an impeller which provides an up-flowing circulation in an axial direction, that is an up-pumping axial flow impeller. The circulation continues upwardly and along the gas liquid interface in the tank and downwardly away from the interface along the inside wall and bottom of the tank, recirculating upwardly into the impeller. There may be a plurality of axial flow up pumping impellers on the shaft spaced from each other successively away from the bottom of the tank. These impellers may be pitched blade turbines or air foil impellers. The design of such impellers may be as described in the above referenced patents or the impellers may be of the type known by Model A-340 sold by Lightnin® Mixers of Mt. Read Boulevard, Rochester, N.Y. 14611, U.S.A. The liquid level may change, for example, by reason of withdrawal of liquid from the tank (drainage) or otherwise, so that the level may be at the impeller or up to about one impeller diameter away from the surface. A conduit, preferably, tubes, which extend along the suction side of the impeller and have outlets where the suction created by the impeller is optimum (approximately at the tips and near the trailing edges of the impeller) rotate with the impeller. These tubes extend to breathing openings above the liquid surface so as to be operative to induce gas into the liquid and out of the tubes, where the gas is dispersed into circulation from the impeller. Gas entrainment occurs because of swelling and turbulence created by the upward flow from the impeller at the surface and especially turbulence at the inside wall of the tank. The mixing system provides efficient gas introduction or sparging as may be measured by the mass transfer coefficient kLa of the system.

The foregoing and other objects, features and advantages of the invention, as well as presently preferred embodiments thereof, will become more apparent from a reading of the following description in connection with the accompanying drawings wherein.

Figure 1:
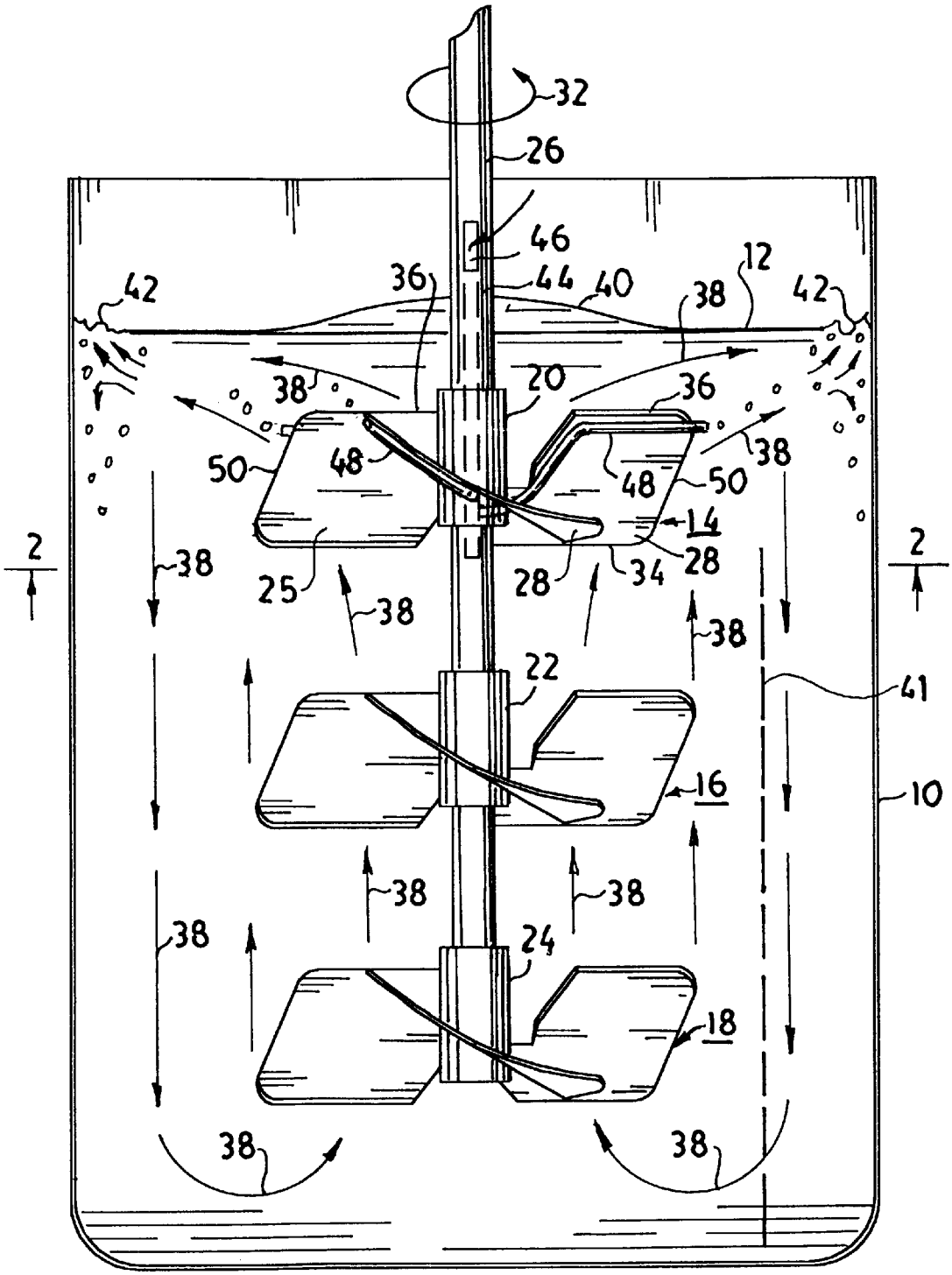
FIG. 1 is an elevational view of a mixing system embodying the invention.
Figure 2:
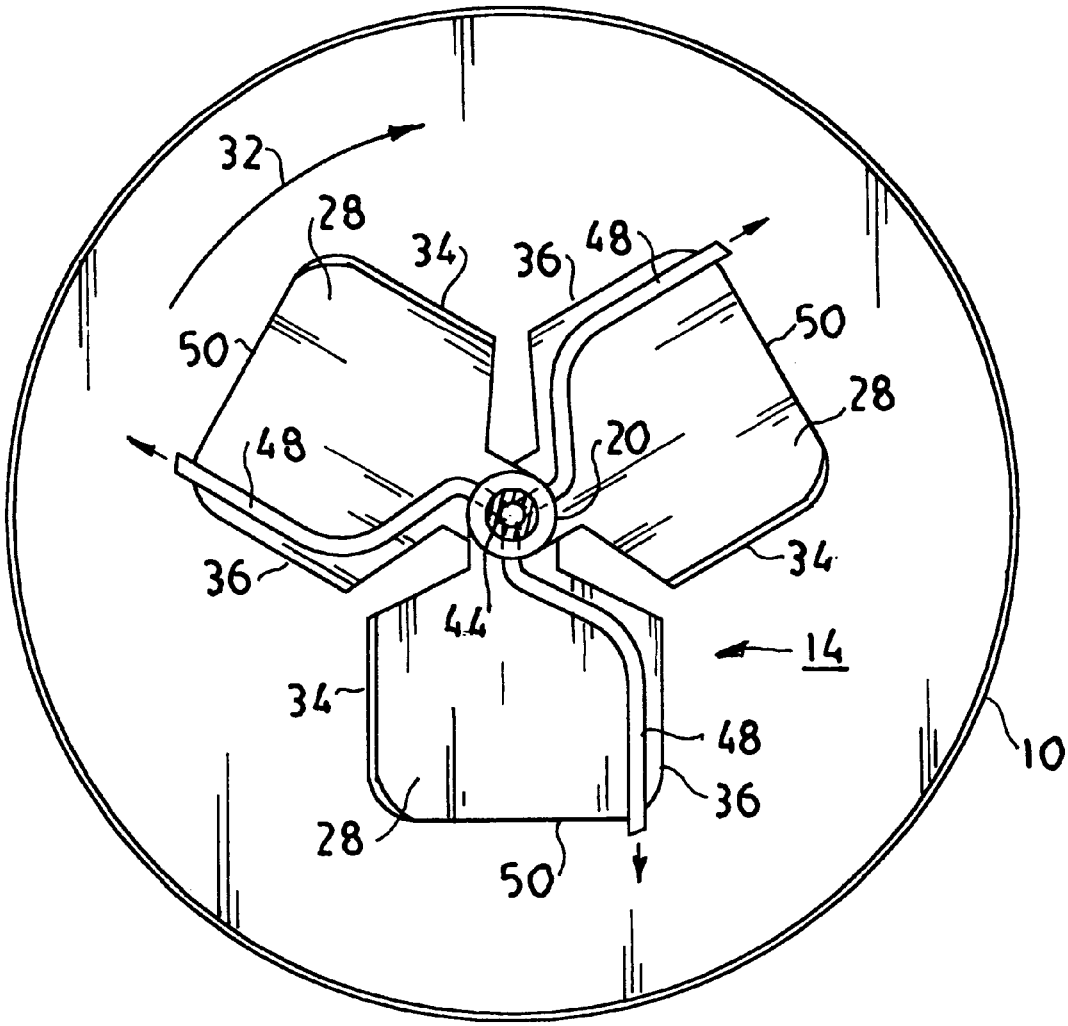
FIG. 2 is a plan view taken along the line 2—2 in the direction of the arrows in FIG. 1.

Referring more particularly to FIGS. 1 and 2 there is shown a tank 10 containing a liquid (by which is meant to include liquid suspensions or slurries in the tank. The liquid may fill the tank to a level 12 when liquid is not circulating (the quiescent level 12). The liquid is circulated by three up-pumping axial flow impellers 14, 16 and 18, which are mounted via hubs 20, 22, and 24 on a shaft 26. This shaft is driven by a motor, and gear box so as to rotate the impellers at the speed to obtain the desired flow rate (cubic feet per minute) in the tank.

The impellers are all identical and the illustrated impellers are three-bladed impellers of the type known as Model A340 which is available from Lightnin® Mixers of Rochester, N.Y. The blade are made out of plates and are curved to present suction 28 and pressure 25 sides, respectively. The blades are pitched so that, in the direction of rotation indicated by the arrows 32, the leading edges 34 of the blades are below or further away from the surface 12 than the trailing edges 36, thereof. Because of the blade angle or pitch and the direction of rotation, the impellers produce axial flow in the upward direction and are therefore, up-pumping axial flow impellers. The circulation in the tank is shown by the array of arrows 38. Baffles may be provided as indicated by dash line 41. This circulation takes into account that the diameter of the impellers D is in the range from 0.4 to 0.65 of the diameter of the tank 10, and also that the lower most impeller 18 is from approximately ⅜ to 1 impeller diameter above the bottom of the tank. The axial upward flow from the upper most impeller 14 turns radial because of the surface or gas liquid interphase shown as the level 12. There is, as shown, a free circulation path to the interphase 12. The upward flow causes a swell 40 and the upward and radial flow causes turbulence, shown at 42 at the inside wall of the tank 10. This swell and turbulence enhances gas entrainment into the liquid at the surface. The entrained gas is picked up by the circulation and carried around the tank and mixed and dispersed so as to effectively provide mass transfer from the gaseous to the liquid phase.

Sparging by induction is enhanced by the use of a conduit provided by an opening or bore 44 in the shaft. Gas enters through a breathing hole 46 and continues into the conduit portion provided by tubes 48. These tubes have entry ends which extend through the shafts into the opening 44 and then on the suction sides, 28 of the blades, along the trailing edges 36 to exits near the tips 50. The exit ends of the tubes 48 may be chamfered at about 45 degrees to the axis of the tubes so as to provide a profile that increases the pressure drop to maximize the gas flow rate. The tubes themselves may, for example, be about ⅜" inside diameter. The tubes rotate with the impeller. The impeller produces a low pressure (below the pressure of the gas above the interface) which is greatest or optimum at the exits of the tubes 48. Gas is then sucked or induced into the liquid at these tubes and exits as bubbles, into the circulation produced by the impeller where the bubbles circulate for mass transfer for the liquid phase in the tanks.

The impellers are not shrouded but nevertheless provide circulation sufficient for efficient mass transfer.

Figure 3:
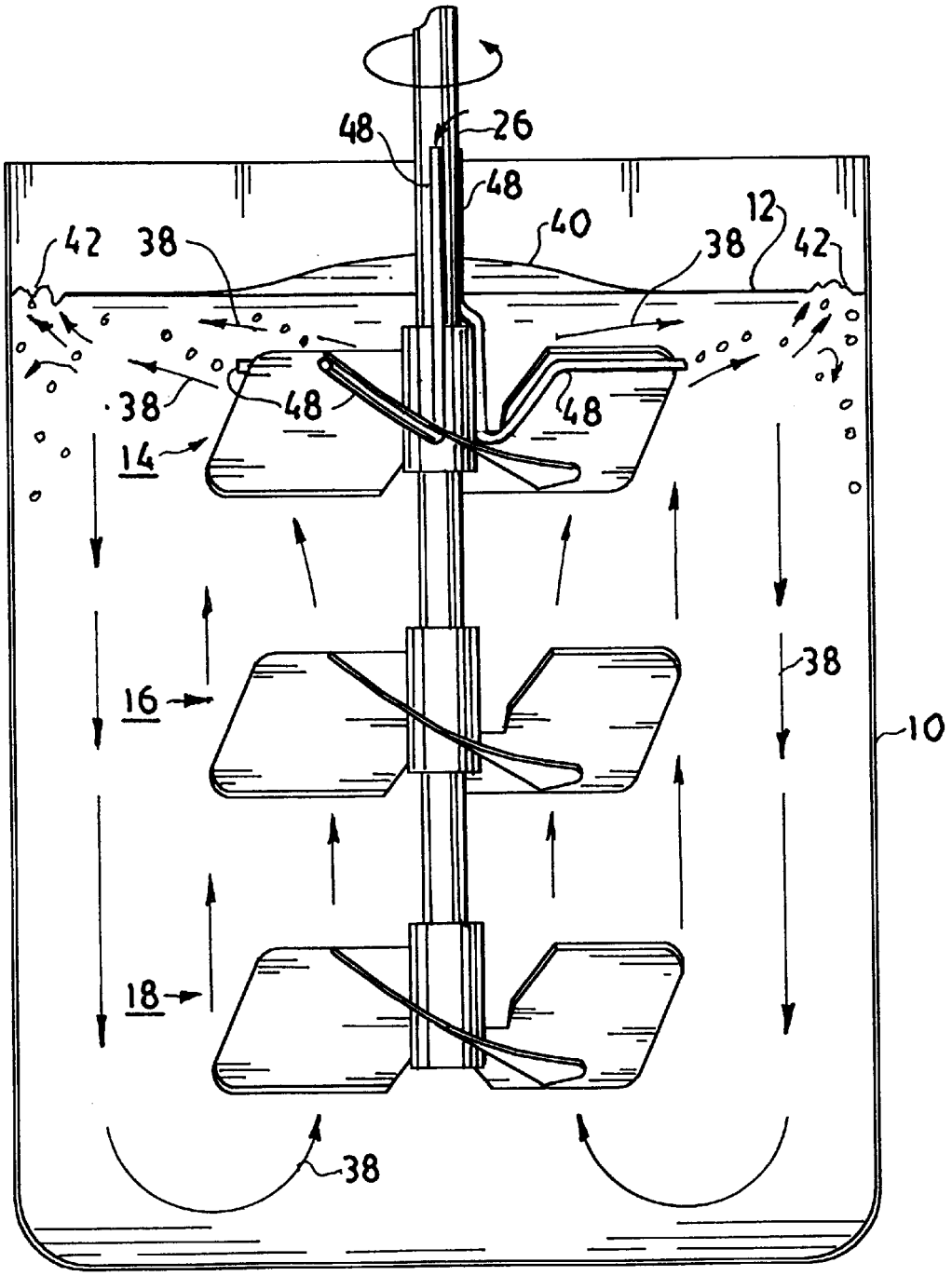
FIG. 3 is an elevational view similar to FIG. 1 showing another embodiment of the invention.

The system shown in FIG. 3 is like the systems shown in FIGS. 1 and 2, however, the tubes 48 extend along the side of the hub 20 and the shaft 26 to locations above the level of the liquid 12. This simplifies the design by eliminating the need for a hollow shaft 26. Moreover, the tubes enhance the turbulence around the shaft and promote the efficiency of gas to liquid mass transfer.

Figure 4:
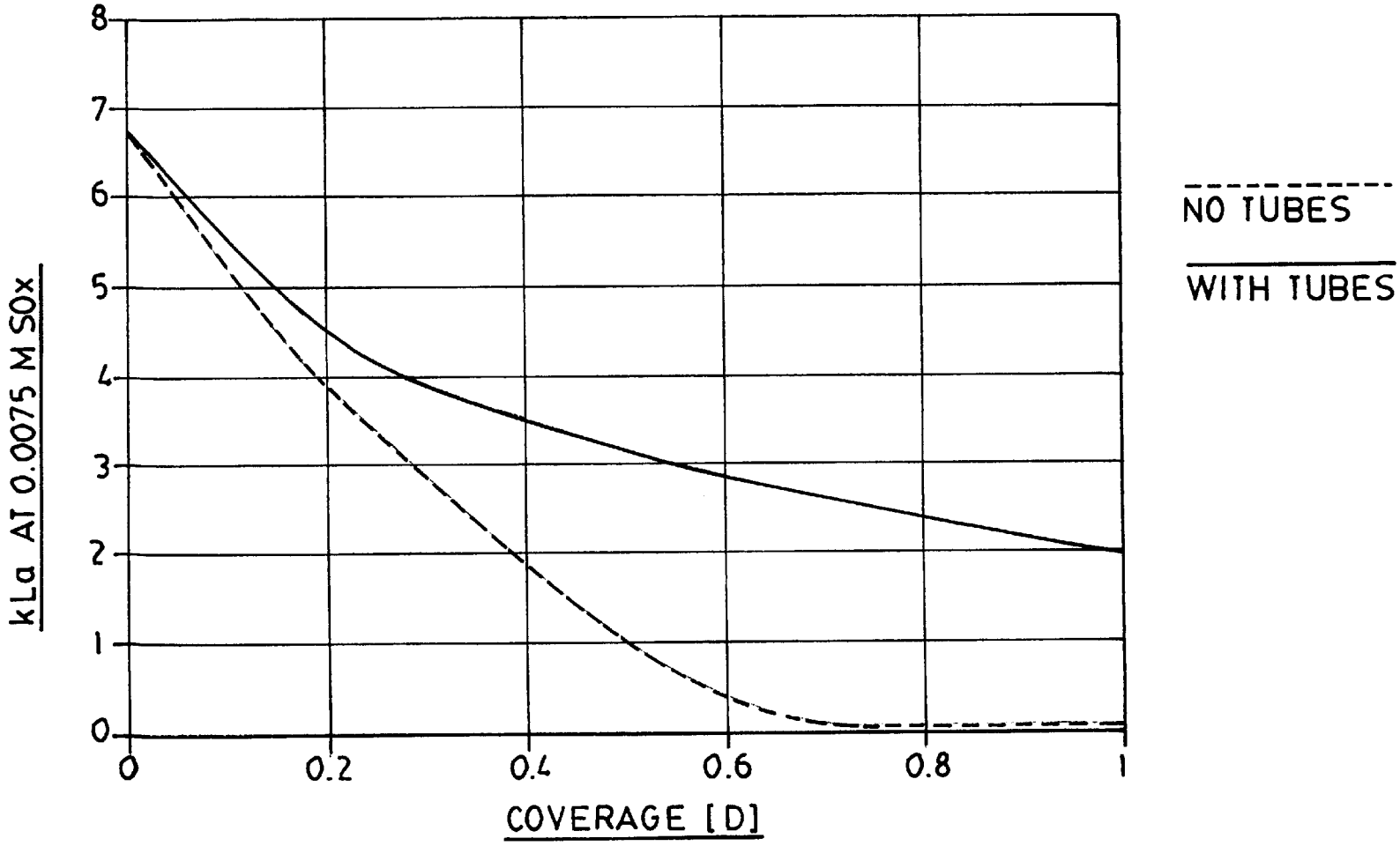
FIG. 4 is a plot illustrating the variation of kLa with liquid level or the distance between the midline of the uppermost impeller in FIGS. 1 and 2 and the surface of the liquid (coverage).

Referring to FIG. 4, there are shown two curves which illustrate the increase and constancy of the mass transfer coefficient kLa with variations in liquid level or coverage over the impeller. The coverage may be measured from the midline of the impeller or from the upper most or trailing edge.

From the foregoing description, it will be apparent that there has been provided an improved mixing system for gas to liquid phase transfer which utilizes up-pumping impellers and surface gas induction. Variations on modifications in the herein described system, within the scope of the invention will undoubtedly suggest themselves to those skilled in the art. Accordingly, the foregoing description should be taken as illustrative and not in a limiting sense.

I claim:

1. A mixing system for circulating a liquid in a tank while introducing gas into said liquid which comprises an impeller which provides circulation upwardly towards a liquid gas interface in said tank and downwardly away from said interface, said impeller being disposed below said interface and being exposed along a free circulation path to said interface and being spaced sufficiently close to said interface to create a swell which entrains said gas above said interface, and at least one conduit rotatable with said impeller and communicating said gas with said liquid in said circulation.

2. The system according to claim 1 wherein the gas above said interface is at a pressure greater than a pressure in a region in said tank with which said conduit provides said communication, thereby sparging said gas by induction into said liquid.

3. The system according to claim 2 wherein said impeller has a plurality of blades mounted for rotation on a shaft, said blades having opposite edges extending radially from said shaft with trailing and leading ones of said edges being respectively closer and further away from said interface, said impeller rotation in said liquid providing said region in the vicinity of said tips.

4. The system according to claim 2 wherein said leading and trailing edges are disposed successively in the direction of rotation of said impeller and said blades are pitched so that said leading edges are further from said interface than said trailing edges to direct said circulation upwardly toward said interface in the discharge flow from said impeller.

5. The system according to claim 3 wherein said impeller is an up pumping axial flow impeller.

6. The system according to claim 3 wherein said conduit has an outlet at one end thereof approximately at said tips.

7. The system according to claim 4 wherein said conduit ascends along the trailing edge of said blades to said tip bringing an open end of said conduit and providing an outlet for said gas approximately at said tip.

8. The system according to claim 7 wherein said conduit extends along said shaft to another open end thereof above said interface providing an inlet for said gas.

9. The system according to claim 7 wherein said shaft has an opening extending axially thereof and providing an inlet for said gas at a breather hole above said interface, said opening in said shaft providing a portion of said conduit, and a tube connected to said opening and extending to approximately said tip and providing the outlet for said gas.

10. The system according to claim 8 wherein said impeller has a plurality of said blades, said conduit comprising a plurality of tubes extending along the trailing edges of said blades to approximately the tips of said blades, said tubes extending along said shaft above said interface to open ends thereof.

11. The system according to claim 9 wherein said shaft has an opening extending axially along said shaft from a breather hole above said interface, said impeller having a plurality of blades, said conduit comprising a plurality of tubes each extending to shaft opening to said openings below said impeller and from said openings below said impeller along suction sides of said blades and along the trailing edges of said blades to opposite ends providing gas outlets approximately at said tips.

12. The system according to claim 3 wherein said impeller is spaced from said interface as such that said impeller is less than from about 1D to at said interface, where D is the diameter of said impeller.

13. The system according to claim 3 wherein said impeller is an unshrouded, up pumping axial flow impeller wherein the volume between said impeller and said tank is open at least to the edges of any baffles along an inside wall of said tank.

14. The system according to claim 3 wherein said impeller is one of a plurality of up pumping axial flow impellers mounted on said shaft and spaced successively further from said interface.

15. The system according to claim 13 wherein said impeller is one of a plurality of up pumping axial flow impellers on said shaft.

16. The system according to claim 15 wherein said plurality of impellers is at least 3 impellers spaced approximately equal distances apart from each other.

* * * * *